US006551225B1

(12) United States Patent
Romero

(10) Patent No.: US 6,551,225 B1
(45) Date of Patent: Apr. 22, 2003

(54) FLEXIBLE HEMISPHERICAL EXERCISE

(76) Inventor: Ron Richard Romero, 2147 Newcastle Ave., Cardiff by the Sea, CA (US) 92007

( * ) Notice: Subject to any disclaimer, the term of this patent is extended or adjusted under 35 U.S.C. 154(b) by 0 days.

(21) Appl. No.: 09/489,809

(22) Filed: Jan. 24, 2000

(51) Int. Cl.[7] ..... A63B 22/14

(52) U.S. Cl. ..... 482/146; 482/77; 482/79; 482/44; 482/145

(58) Field of Search ..... 482/146, 145, 482/44, 49, 75–80, 47, 48

(56) References Cited

U.S. PATENT DOCUMENTS 2,242,748 A * 4/1941 Fulwiler ..... 272/70
2,283,595 A * 5/1942 Banister ..... 36/7.5
4,191,371 A * 3/1980 Armer, Jr. ..... 482/146
4,492,374 A * 1/1985 Lekhtman et al. ..... 482/77
4,774,776 A * 10/1988 Gulli ..... 36/132
5,205,798 A * 4/1993 Lekhtman ..... 482/77
5,267,927 A * 12/1993 Catanzano et al. ..... 482/105
5,301,441 A * 4/1994 Kownacki ..... 36/7.8
5,343,636 A * 9/1994 Sabol ..... 36/7.8
5,643,148 A * 7/1997 Naville ..... 482/77
5,685,807 A * 11/1997 Tong et al. ..... 482/77
5,702,354 A * 12/1997 DeSpain et al. ..... 601/27
5,897,474 A * 4/1999 Romero ..... 482/146
5,916,071 A * 6/1999 Lee ..... 482/77
6,238,325 B1 * 5/2001 Oxford ..... 482/146

* cited by examiner

*Primary Examiner*—Nicholas D. Lucchesi
*Assistant Examiner*—Lori Baker Amerson
(74) *Attorney, Agent, or Firm*—Thomas I. Rozsa; Tony D. Chen

(57) ABSTRACT

A balancing exercise device for an individual, having a flexible hemisphere having a flat circular surface and a hemispherical side surface and being made out of flexible resilient material which will compress when placed under pressure and pair of attachment straps respectively affixed on oppositely disposed sides of the hemispherical side surface and which are connected by connecting members respectively located on each attachment strap so that a body part is held against said flat circular surface when the attachment straps are connected. When each hemispherical side surface is respectively placed against an immovable object and each respective body part is respectively pressed against the flat circular surface of the flexible hemisphere to which it is attached, constant variations of movement in any and all directions of the hemisphere surface puts different stretch on the tendons, muscles, ligaments and joints and thereby stimulates increased numbers of proprioceptors and nerve cells of the body parts and further thereby creates more activation of the muscles and causes the body parts to be exercised completely and evenly.

21 Claims, 2 Drawing Sheets

FLEXIBLE HEMISPHERICAL EXERCISE

BACKGROUND OF THE INVENTION

1. Field of the Invention

The present invention generally relates to the field of exercise devices. More particularly, the present invention relates to the field of multi-purpose balancing exercise devices.

2. Description of the Prior Art

Numerous exercise devices are well known in the prior art. One particular subset of exercise devices are known as balancing exercise devices.

One type of balancing exercise device is disclosed and claimed in U.S. Pat. No. 5,897,474 for Balancing And Exercise Device invented by the inventor of the present invention. This device involves a board combined with a flexible ball, wherein the board rests on or against the ball and the person balances a body part on the board.

Another type of balancing exercise device is known as a Horai-geta which consists of a hard plane such as a wooden board on which a person stands while the other side of the board is balanced on a hemisphere.

In addition, another type of exercise device are exercise sandals. In this type of device, the sandals feature a sandal having an adjustable leather strap and a hemisphere on the base of the cork sandals which is affixed to the base of the cork sandal so that a user can walk in the sandals and concurrently walk on the hemispheres.

Finally, another balancing device is known as a UE Board and Ball which consists of a disc having an attachment to be grasped by one hand with the user pushing the disc against a ball. This device can only be used with a pushaway against a wall and cannot be used against the floor.

None of these devices provides a simple, efficient, balancing device which can be used to exercise both the user's upper and lower body arms and legs and related adjacent body parts. There is a substantial need for such a device.

SUMMARY OF THE INVENTION

The present invention is a unique biomechanical balancing and exercise device which can be used for general well-being exercise and also used in rehabilitation centers to rehabilitate upper and lower body joints such as ankles, legs, knees, hands, wrists, arms, shoulders and back.

The present invention comprises at least one balance device which comprises a flexible hemisphere having one flat surface that is soft and a rounded hemispherical surface that may be compressible or non-compressible when under pressure and which further can be pivotable in any direction. The device further comprises retaining means which enables the flexible hemispherical balancing exercise device to be removably secured to a body part such as a user's foot or hand.

It has been discovered, according to the present invention, that an exercise device which comprises a flat surface for securing the device to a body part and a flexible hemisphere which is compressible under pressure provides a very efficient exercise device when attached to a body part so the hemispherical surface has a constant variation of movement in any and all directions and puts different stretch on the tendons, muscles, ligaments, and joints, stimulating increased numbers of proprioceptors and nerve cells of a body part thereby creating more muscle activation. Changing the orientation of the hemisphere relative to any immovable object or using a variety of stances or positions stimulates increased numbers of proprioceptors. By way of example, the knee being bent or straight will put a different tension on the muscle to stretch and cause more proprioceptor stimulation.

It has been further discovered, according to the present invention, that when an exercise device which comprises a flat surface and a flexible hemispherical surface is secured by attaching means to the underside of a user's foot or to the sole of the user's shoe, then the user can walk or stand still on the hemispherical portion so that the muscle of the foot, ankle, leg, knee and back are exercised. In the preferred embodiment, the exercise device comprises a pair of flexible hemispheres with flat surfaces so that a respective exercise device is attached to the sole of a person's foot or to the sole of the shoe the person is wearing on each respective foot so that the person can walk on the flexible hemispheres and the hemispheres will rock back and forth or move in any direction, to thereby exercise muscles in the person's foot and leg and further exercise muscles and joints in the person's ankles and knees and pelvis. By changing the orientation of the hemispheres relative to the ground as the person walks, different proprioceptors and nerve cells are stimulated, thereby creating more muscle activation.

It has been further discovered, according to the present invention, that when an exercise device which comprises a flat surface and a flexible hemispherical surface is secured by attaching means to the user's hand, when the user pushes a portion of the flexible hemisphere against a surface, it enables the muscles of the hand and the arm to be exercised and further exercises joints such as the person's shoulder, wrist and elbow. By using only one or two exercise devices against the fist of one or two hands, a person can push the hemispherical portion against a wall and do vertical push-ups. If the person is in the horizontal position, then the hemispherical portion can be pushed against the floor so that the person can do a push-up to stimulate proprioceptors in the body parts, and thereby exercise the shoulders, hand and arm muscles, exercise joints in the wrist and elbow and shoulder. Further, by changing the orientation of the hemisphere against the wall or floor, the user thereby stimulates increased numbers of proprioceptors and nerve cells. In the preferred embodiment, the exercise device comprises a pair of flexible hemispheres with a flat surface so that a respective exercise device is attached to a person's hand so that the person can do two handed push-ups against the floor or two handed pushaways against a wall to thereby stimulate increased numbers of proprioceptors and therefore activate more muscles in the person's hands, arms, wrists, elbows, shoulders and back. By changing the orientation of the hemisphere relative to the flat surface against which it is applied (the wall or ground) as a person pushes against and then away from the wall or ground stretches tendons, muscles, and ligaments, thereby stimulating more proprioceptors in the person's wrist, elbow, shoulder and back which creates more muscle activations of the muscles to be exercise in the person's hands, wrist, arm, shoulder and back.

It has been discovered that the present invention can be used for general exercise on the body part and also to rehabilitate the body part if it has been injured or if muscles or ligaments have been sprained or strained.

It is therefore an object of the present invention to provide a simple and efficient exercise device which can be used in a multiplicity of ways to stimulate proprioceptors and nerves to thereby create more muscle activation of a user's body parts including foot, ankle, leg, knee, hand, wrist, arm, elbow, shoulder and back.

It is a further object of the present invention to provide a simple and efficient balancing exercise device which has a flat surface which can be attached by attaching means such as straps to the person's body part and a hemispherical portion which is compressible under pressure when the exercise device is pressed against an immovable surface.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFEFRRD EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
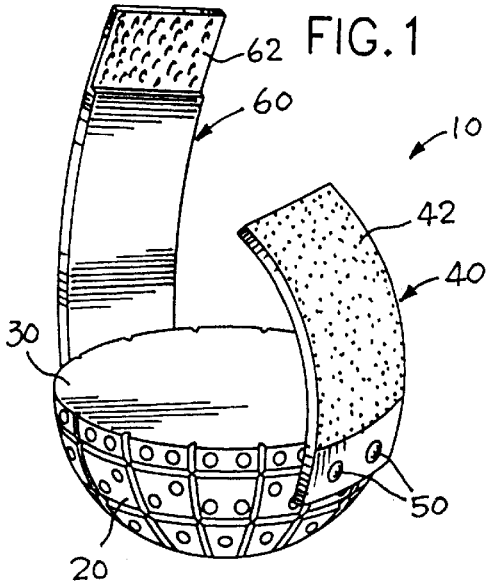
FIG. 1 is a perspective view of the present invention flexible hemispherical exercise device.

Referring to FIG. 1, there is shown at 10 a perspective view of the present invention flexible hemispherical exercise device. The flexible hemispherical exercise device 10 is made out of a single piece of flexible material such as rubber, neoprene, plastic or any flexible polymer which maintains in shape but can be slightly compressed when placed under pressure. The flexible hemispherical exercise device 10 comprises a hemispherical surface 20 and a flat surface 30. By way of example only, the circumference of the flat circular surface 30 may be approximately 12 inches and the depth of the hemisphere may be approximately 2 inches.

Attached to at least one surface is an attaching means. By way of example and illustration only, the attaching means shown comprises a first strap member 40 attached to a portion of the hemispherical surface 20 by first strap attaching means 50. By way of example, the first strap member 40 may be attached to the hemispherical surface 20 by screws 50. The attaching means further comprises a mating second strap member 60 which is attached to another oppositely disposed portion of the hemispherical surface 20 by second strap attaching means (not shown). By way of example, the second strap member 60 may be attached to the hemispherical surface 20 by screws not shown but similar to the screws 50. The strap members 40 and 60 and respective connecting members 42 and 62 enable the straps to be attached tightly together and cause a body part to be removably held against the flat surface 30. By way of example only, the preferred embodiment of the two connecting members are mating male and female hook and loop fasteners, commonly known as Velcro®. It will be appreciated that any other suitable connecting members, including buckles, fasteners, snaps, etc. are within the spirit and scope of the present invention. It will further be appreciated that even though the attaching means is shown being connected to opposite sides of the hemispherical portion, it is also within the spirit and scope of the present invention to have the attachment means connected to opposite locations on the flat surface 30.

Figure 2:
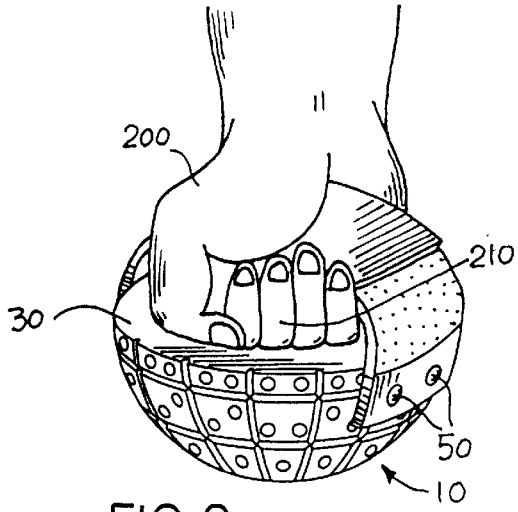
FIG. 2 is a perspective view of a person's fist being firmly set against the flat surface of the present invention flexible hemispherical exercise device, with the person's fingers grasping the attaching means.

Referring to FIG. 2, there is illustrated a perspective view of a person's fist 200 being firmly held against the flat surface 30 of the flexible hemispherical exercise device 10 by having a portion of the person's fingers fist against the flat surface 30 while the person's fingers 210 are wrapped around the first and second strap members 40 and 60 of the attachment means.

Figure 3:
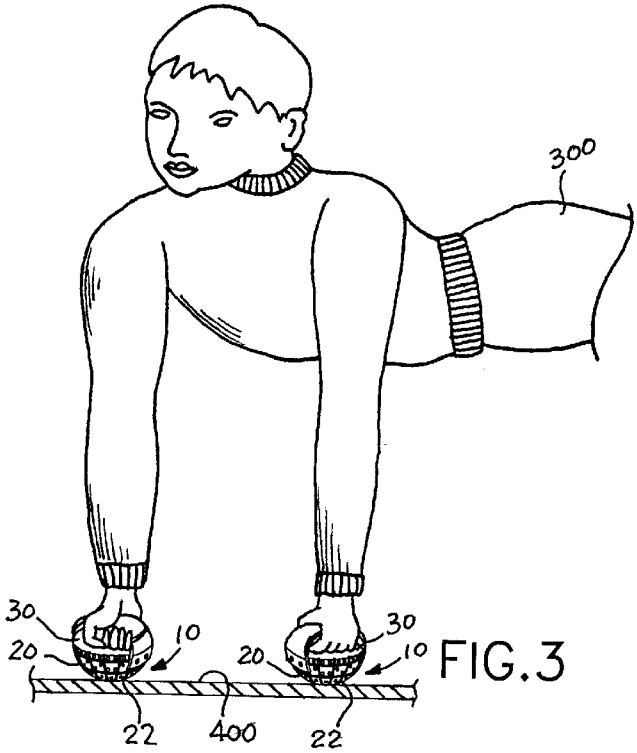
FIG. 3 is a perspective view of both fists of the person being firmly set against the flat surface of a respective one of the present invention flexible hemispherical exercise device, with the person's fingers wrapped around the attaching means, and with the person doing push-ups on the floor.

Referring to FIG. 3, there is illustrated a pair of flexible hemispherical exercise devices 10 attached in the manner just described and illustrated in FIG. 2, with a respective one flexible hemispherical exercise device 10 attached to a respective hand, and the person 300 doing push-ups against a floor 400. As illustrated in FIG. 3, each respective hemispherical portion 20 is pressed against the floor and slightly compressed as the person 300 pushes down during the push-up exercise. In the illustration in FIG. 3, the most remote tip end 22 of the hemispherical surface 20 is against the floor 300. In this manner, muscles of the hand, wrist, arm, elbow, shoulder and back are exercised and proprioceptors and nerve cells of these body parts are stimulated. Alternatively, the hemispherical surface 20 can be rotated forwardly away from the person as the push-ups are performed to stimulate other proprioceptors and nerve cells of the muscles, ligaments, tendons and joints, creating more muscle activation and exercise the muscles more completely and evenly. The hemispherical surface 20 can be rotated backwardly or toward the person 300 as the push-ups are performed to exercise other locations of these body parts and stimulate other proprioceptors and nerve cells of these body parts. Similarly, the hemispherical surface 20 can be rotated to one side or the other to create different angles as the push-up are performed to stimulate other proprioceptors and nerve cells, thereby creating more muscle activation. In this manner the hands, arms, wrist, elbows, shoulders and back can be exercised for both a person's well-being and/or to rehabilitate an injured body part. In addition, while the exercise is illustrated with the person lying horizontally and doing push-ups, it will be appreciated that the person can also be standing erect and facing a wall and doing the same push-ups or pushaways while standing and using the wall as the immovable surface against which the hemispherical surface 20 is pressed.

Figure 4:
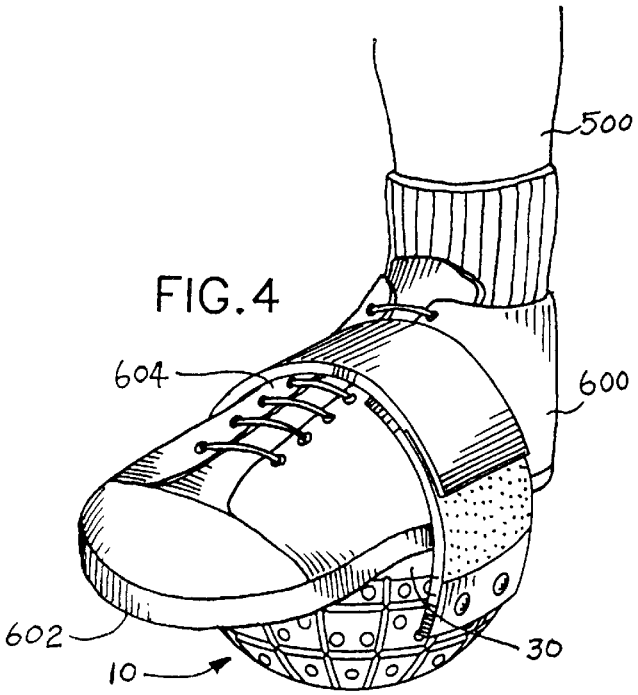
FIG. 4 is a perspective view of a person's left foot in a tennis shoe, with the tennis shoe being firmly held against the flat surface of the flexible hemispherical exercise device.

Referring to FIG. 4, there is illustrated a perspective view of a person's left foot 500 in a shoe 600 which can be a tennis shoe, with the shoe 600 being firmly held against the flat surface 30 of the flexible hemispherical exercise device 10 by having the outsole 602 of the shoe 600 lying against the flat surface 30 and the attachment means tightly wrapped against the top 604 of the shoe 600 so that the shoe 600 with the person's foot 500 in it is tightly held against the flat surface 30 of the flexible hemispherical exercise device 10. It will be appreciated that the person's bare foot can also be held against the flat surface 30 in the same manner with the sole of the person's foot against the flat surface 30 and the attachment means tightly wrapped against the top of the person's foot to hold it against the flexible hemispherical exercise device 10. The preferred embodiment is for the person to be wearing shoes, such as flat bottom shoes.

Figure 5:
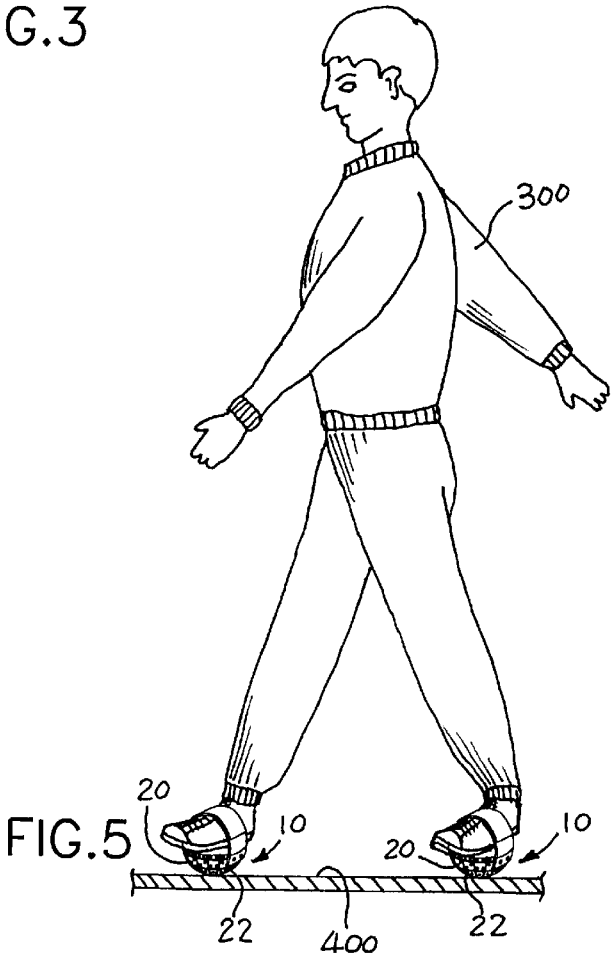
FIG. 5 is a perspective view of a pair of flexible hemispherical exercise devices attached to a respective one of the pair of a person's tennis shoes, and the person walking on a floor.

Referring to FIG. 5, there is illustrated a pair of flexible hemispherical exercise devices 10 attached in the manner just described and illustrated in FIG. 4, with a respective one flexible hemispherical exercise device 10 attached to a respective tennis shoe, and the person 300 walking or standing still on the floor 400. As illustrated in FIG. 5, each respective hemispherical surface 20 is pressed against the floor and slightly compressed as the person 300 walks or stands still. In the illustration in FIG. 5, the most remote tip end 22 of the hemispherical surface 20 is against the floor. In this manner, increased numbers of proprioceptors and nerve cells of these body parts are stimulated and this activates more muscles of the foot, ankle, leg, knee, pelvis, shoulder and back which are exercised. Alternatively, the hemispherical surface 20 can be rotated forwardly from the person as the person walks or stands still to stimulate other proprioceptors and nerve cells of these body parts and create more muscle activation and exercise the muscles more completely and evenly to these body parts. The hemispherical surface 20 can be rotated backwardly from the person 300 as the person walks or stands still to stimulate other proprioceptors and nerve cells of these body parts and create more muscle activation of the muscles of these body parts. Similarly, the hemispherical surface 20 can be rotated to one side or the other to create different angles as the person walks or stands still to cause stimulation of other proprioceptors and nerve cells in these body parts and create more muscle activation of the muscles of these body parts so that they are exercised more completely and evenly. In this manner the foot, ankle, leg, knee, pelvis and back can be exercised for both personal well-being and/or to rehabilitate an injured body part. Walking has the advantage of more proprioceptive action to improve the muscles of gait.

Figure 6:
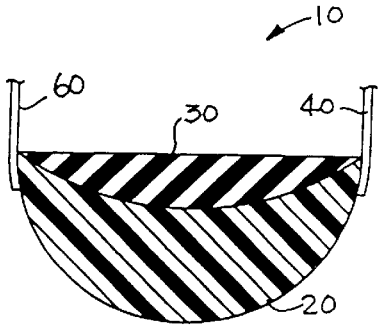
FIG. 6 is a cross-sectional view of the preferred embodiment of the flexible hemispherical exercise device.

Referring to FIG. 6, in the preferred embodiment of the present invention flexible hemispherical exercise device 10, the hemispherical exercise device 10 can be made from several materials. The manufacturing process which could accommodate the construction of the flexible hemispherical exercise device 10 may be injection, thermoform, etc. or other molding process. By way of example, the hemispherical surface 20 is made out of a semi-flexible material which is slightly compressible on a hard floor or ground while the flat surface 30 is made out of softer material, such as soft foam for protecting the knuckles of a user hand when the knuckles are positioned on the flat surface 30.

Figure 7:
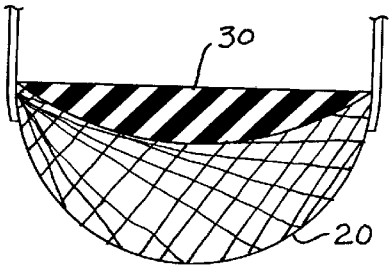
FIG. 7 is a cross-sectional view of an alternative preferred embodiment of the flexible hemispherical exercise device.

Referring to FIG. 7, in an alternative embodiment of the present invention hemispherical exercise device, the hemispherical exercise device can be made from several materials. By way of example, the hemispherical surface 20 is made out of a harder rigid material, such as wood or other suitable material which is non-compressible while the flat surface 30 is made out of softer material, such as soft foam for protecting the knuckles of a user hand when the knuckles are positioned on the flat surface 30. By way of example, utilizing the harder rigid material, the hemispherical exercise device must be used on a softer surface, such as carpet or other suitable softer surfaces. By way of example, a mat or pad can be used with the harder rigid material of the hemispherical exercise device, where the mat or pad may be affixed to a wall for performing stand-up push-up exercises or positioned over the floor for performing regular push-up exercises or other type of exercises.

Defined in detail, the present invention is a balancing exercise device for an individual, comprising: (a) a flexible hemisphere having a flat circular surface and a hemispherical side surface and being made out flexible resilient material which will compress when placed under pressure; and (b) a pair of attachment straps respectively affixed on oppositely disposed sides of the hemispherical side surface and which are connected by connecting members respectively located on each attachment strap so that a body part is held against the flat circular surface when the attachment straps are connected; (c) whereby when the hemispherical surface is placed against an immovable object and the body part is pressed against the flat circular surface of the flexible hemisphere to which it is attached, constant variations of movement in any directions of the hemispherical surface puts different stretch on the tendons, muscles, ligaments and joints and thereby stimulates increase number of proprioceptors and nerve cells of the body part and further thereby creates more activation of the muscles and causes the body part to be exercised more completely and evenly.

Defined broadly, the present invention is a balancing exercise device for an individual, comprising: (a) a pair of flexible hemispheres, each flexible hemisphere having a flat circular surface and a hemispherical side surface and being made out flexible resilient material which will compress when placed under pressure; and (b) said each flexible hemisphere having a pair of attachment straps respectively affixed on oppositely disposed sides of the hemispherical side surface and which are connected by connecting members respectively located on each attachment strap so that a respective body part is held against the flat circular surface of a respective flexible hemisphere when the attachment straps are connected; (c) whereby when said each hemispherical surface is respectively placed against an immovable object and each respective body part is respectively pressed against the flat circular surface of said each flexible hemisphere to which it is attached, constant variations of movement in any and all directions of the hemispherical surface puts different stretch on the tendons, muscles, ligaments and joints and thereby stimulates increase number of proprioceptors and nerve cells of the body parts and further thereby creates activation of the muscles and causes the body parts to be exercised more completely and evenly.

Defined more broadly, the present invention is a balancing exercise device for an individual, comprising: (a) a flexible hemisphere having a flat surface and a hemispherical surface and being made out flexible resilient material which will compress when placed under pressure; and (b) attachment means affixed on oppositely disposed sides of the hemispherical surface so that a body part is held against the flat surface by the attachment means; (c) whereby when the hemispherical surface is placed against an immovable object and the body part is pressed against the flat surface of the flexible hemisphere to which it is attached, constant variations of movement in any and all directions of the hemispherical surface puts different stretch on the tendons, muscles, ligaments and joints and thereby stimulates increase number of proprioceptors and nerve cells of the body part and further thereby creates more activation of the muscles and causes the body part to be exercised more completely and evenly.

Defined even more broadly, the present invention is a balancing exercise device for an individual, comprising: (a) a pair of flexible hemispheres, each flexible hemisphere having a flat surface and a hemispherical surface and being made out flexible resilient material which will compress when placed under pressure; and (b) the each flexible hemisphere having respective attachment means respectively affixed on oppositely disposed sides of the hemispherical surface so that a respective body part is held against the flat surface of a respective flexible hemisphere by the attachment means; (c) whereby when the each hemispherical surface is respectively placed against an immovable object and each respective body part is respectively pressed against the flat surface of the each flexible hemisphere to which it is attached, constant variations of movement in any and all directions of the hemispherical surface puts different stretch on the tendons, muscles, ligaments and joints and thereby stimulates increase number of proprioceptors and nerve cells of the body parts and further thereby creates more activation of the muscles and causes the body parts to be exercised completely and evenly.

Defined still even more broadly, the present invention is a balancing exercise device for an individual, comprising: (a) a flexible hemisphere having a flat surface and a hemispherical surface and being made out flexible resilient material which will compress when placed under pressure; and (b) attachment means affixed to the balancing exercise device so that a body part is held against the flat surface by the attachment means; (c) whereby when the hemispherical surface is placed against an immovable object and the body part is pressed against the flat surface of the flexible hemisphere to which it is attached, constant variations of movement in any and all directions of the hemispherical surface puts different stretch on the tendons, muscles, ligaments and joints and thereby stimulates increase number of proprioceptors and nerve cells of the body part and further thereby create activation of the muscles and causes the body part to be exercised more completely and evenly.

Further defined still more broadly, the present invention is a balancing exercise device for an individual, comprising: (a) a pair of flexible hemispheres, each flexible hemisphere having a flat surface and a hemispherical surface and being made out flexible resilient material which will compress when placed under pressure; and (b) the each flexible hemisphere having respective attachment means respectively affixed on the hemispherical surface so that a respective body part is held against the flat surface of the each flexible hemisphere by the attachment means; (c) whereby when the each hemispherical surface is respectively placed against an immovable object and each respective body part is respectively pressed against the flat surface of the each flexible hemisphere to which it is attached, constant variations of movement in any and all directions of the hemispherical surface puts different stretch on the tendons, muscles, ligaments and joints and thereby stimulates increase number of proprioceptors and nerve cells of the body parts and further thereby creates more activation of the muscles and causes the body parts to be exercised completely and evenly.

Further defined still even more broadly, the present invention is a balancing exercise device for an individual, comprising: (a) a hemisphere having a flat surface and a hemispherical surface which is non-compressible when placed under pressure; and (b) a pair of attachment straps respectively affixed on oppositely disposed sides of the hemispherical surface and which are connected by connecting members respectively located on each attachment strap so that a body part is held against the flat surface when the attachment straps are connected; (c) whereby when the hemispherical surface is placed against an immovable object and the body part is pressed against the flat surface of the hemisphere to which it is attached, constant variations of movement in any and all directions of the hemispherical surface puts different stretch on the tendons, muscles, ligaments and joints and thereby stimulates increase number of proprioceptors and nerve cells of the body part and further thereby creates more activation of the muscles and causes the body part to. be exercised more completely and evenly.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A balancing exercise device for an individual, comprising:

a. a flexible solid hemisphere having a flat circular surface and a hemispherical side surface and being made out flexible resilient material which will slightly compress when placed under pressure; and b. a pair of attachment straps respectively affixed on oppositely disposed sides of said hemispherical side surface and which are connected by connecting members respectively located on each attachment strap for holding a body part against said flat circular surface when the attachment straps are connected;

c. whereby when the hemispherical surface is placed against an immovable object and the body part is pressed against the flat circular surface of the flexible hemisphere to which it is attached, constant variations of movement in any and all directions of the hemispherical surface puts different stretch on the tendons, muscles, ligaments and joints and thereby stimulates increase number of proprioceptors and nerve cells of the body part and further thereby creates more activation of the muscles and causes the body part to be exercised more completely and evenly.

2. The balancing and exercise device as defined in claim 1, wherein said flexible hemisphere is made of rubber.

3. The balancing and exercise device as defined in claim 1, wherein said connecting members are male and female hook and loop fasteners.

4. The balancing and exercise device as defined in claim 1, wherein said flat circular surface has a circumference of approximately twelve inches.

5. The balancing and exercise device as defined in claim 1, wherein said flexible hemisphere is approximately two inches high from the tip of the hemisphere to the flat circular surface.

6. A balancing exercise device for an individual, comprising:

a. a pair of flexible solid hemispheres, each flexible hemisphere having a flat circular surface and a hemispherical side surface and being made out flexible resilient material which will slightly compress when placed under pressure; and b. each flexible hemisphere having a pair of attachment straps respectively affixed on oppositely disposed sides of the hemispherical side surface and which are connected by connecting members respectively located on each attachment strap for holding a respective body part against said flat circular surface of a respective flexible hemisphere when the attachment straps are connected;

c. whereby when said each hemispherical surface is respectively placed against an immovable object and each respective body part is respectively pressed against the flat circular surface of said each flexible hemisphere to which it is attached, constant variations of movement in any and all directions of the hemispherical surface puts different stretch on the tendons, muscles, ligaments and joints and thereby stimulates increase number of proprioceptors and nerve cells of the body parts and further thereby creates more activation of the muscles and causes the body parts to be exercised more completely and evenly.

7. The balancing and exercise device as defined in claim 6, wherein said each flexible hemisphere is made of rubber.

8. The balancing and exercise device as defined in claim 6, wherein said connecting members are male and female hook and loop fasteners.

9. The balancing and exercise device as defined in claim 6, wherein said flat circular surface has a circumference of approximately twelve inches on said each flexible hemisphere.

10. The balancing and exercise device as defined in claim 6, wherein said each flexible hemisphere is approximately two inches high from the tip of the hemisphere to the flat circular surface.

11. A balancing exercise device for an individual, comprising:

a. a flexible solid hemisphere having a flat surface and a hemispherical surface and being made out flexible resilient material which will slightly compress when placed under pressure; and b. attachment means affixed on oppositely disposed sides of the hemispherical surface for holding a body part against said flat surface by said attachment means;

c. whereby when the hemispherical surface is placed against an immovable object and the body part is pressed against the flat surface of the flexible hemisphere to which it is attached, constant variations of movement in any and all directions of the hemispherical surface puts different stretch on the tendons, muscles, ligaments and joints and thereby stimulates increase number of proprioceptors and nerve cells of the body part and further thereby creates more activation of the muscles and causes the body part to be exercised more completely and evenly.

12. The balancing and exercise device as defined in claim 11, wherein said flexible hemisphere is made of rubber.

13. A balancing exercise device for an individual, comprising:

a. a pair of flexible solid hemispheres, each flexible hemisphere having a flat surface and a hemispherical surface and being made out flexible resilient material which will slightly compress when placed under pressure; and b. said each flexible hemisphere having respective attachment means respectively affixed on oppositely disposed sides of the hemispherical surface for holding a respective body part against said flat surface of a respective flexible hemisphere by said attachment means;

c. whereby when said each hemispherical surface is respectively placed against an immovable object and each respective body part is respectively pressed against the flat surface of said each flexible hemisphere to which it is attached, constant variations of movement in any and all directions of the hemispherical surface puts different stretch on the tendons, muscles, ligaments and joints and thereby stimulates increase number of proprioceptors and nerve cells of the body parts and further thereby creates more activation of the muscles and causes the body parts to be exercised more completely and evenly.

14. The balancing and exercise device as defined in claim 13, wherein said each flexible hemisphere is made of rubber.

15. A balancing exercise device for an individual, comprising:

a. a flexible solid hemisphere having a flat surface and a hemispherical surface and being made out flexible resilient material which will slightly compress when placed under pressure; and b. attachment means affixed to said balancing exercise device for holding a body part against said flat surface by said attachment means;

c. whereby when the hemispherical surface is placed against an immovable object and the body part is pressed against the flat surface of the flexible hemisphere to which it is attached, constant variations of movement in any and all directions of the hemispherical surface puts different stretch on the tendons, muscles, ligaments and joints and thereby stimulates increase number of proprioceptors and nerve cells of the body part and further thereby creates more activation of the muscles and causes the body part to be exercised more completely and evenly.

16. The balancing and exercise device as defined in claim 15 wherein said flexible hemisphere is made of rubber.

17. A balancing exercise device for an individual, comprising:

a. a pair of flexible solid hemispheres, each flexible hemisphere having a flat surface and a hemispherical surface and being made out flexible resilient material which will slightly compress when placed under pressure; and b. said each flexible hemisphere having respective attachment means respectively affixed on said hemispherical surface for holding a respective body part against said flat surface of said each flexible hemisphere by the attachment means;

c. whereby when said each hemispherical surface is respectively placed against an immovable object and each respective body part is respectively pressed against the flat surface of said each flexible hemisphere to which it is attached, constant variations of movement in any and all directions of the hemispherical surface puts different stretch on the tendons, muscles, ligaments and joints and thereby stimulates increase number of proprioceptors and nerve cells of the body parts and further thereby creates more activation of the muscles and causes the body parts to be exercised completely and evenly.

18. The balancing and exercise device as defined in claim 17, wherein said each flexible hemisphere is made of rubber.

19. A balancing exercise device for an individual, comprising:

a. a solid hemisphere having a flat surface and a hemispherical surface which is non-compressible when placed under pressure; and b. a pair of attachment straps respectively affixed on oppositely disposed sides of said hemispherical surface and which are connected by connecting members respectively located on each attachment strap for holding a body part against said flat surface when the attachment straps are connected;

c. whereby when said hemispherical surface is placed against an immovable object and the body part is pressed against said flat surface of said hemisphere to which it is attached, constant variations of movement in any and all directions of said hemispherical surface puts different stretch on the tendons, muscles, ligaments and joints and thereby stimulates increase number of proprioceptors and nerve cells of the body part and further thereby creates more activation of the muscles and causes the body part to be exercised more completely and evenly.

20. The balancing and exercise device as defined in claim 19, wherein said flat surface is made out of rubber material.

21. The balancing and exercise device as defined in claim 19, wherein said hemispherical surface is made out of wood material.

* * * * *